United States Patent [19]

Teodorescu et al.

[11] 4,090,814

[45] May 23, 1978

[54] GAS-LIFT DEVICE

[75] Inventors: Constantin Teodorescu; Ilie Chiriac; Cornel Doru Sava; Adrian Drăghici; Sabin Zincă, all of Bucharest, Romania

[73] Assignee: Institutul National Pentru Creatie Stiintifica si Tehnica, Bucharest, Romania

[21] Appl. No.: 653,004

[22] Filed: Jan. 28, 1976

[30] Foreign Application Priority Data

Feb. 12, 1975 Romania ..... 7581391

[51] Int. Cl.[2] ..... F04F 5/00

[52] U.S. Cl. ..... 417/178; 417/197

[58] Field of Search ..... 417/160, 171, 172, 177, 417/178, 194, 195–198, DIG. 1; 239/DIG. 7; 137/155

[56] References Cited

U.S. PATENT DOCUMENTS

| | | | |
|---|---|---|---|
| 857,768 | 6/1907 | Stirling | 417/197 |
| 992,144 | 5/1911 | Babcock | 417/197 X |
| 1,737,684 | 12/1929 | Reynolds | 417/197 |
| 1,865,623 | 7/1932 | Eidsmore | 417/177 |
| 1,867,876 | 7/1932 | Clark | 417/195 |
| 2,608,801 | 9/1952 | Ridley | 417/195 |
| 3,022,685 | 2/1962 | Armacost | 417/DIG. 1 |
| 3,765,152 | 10/1973 | Pausch | 417/197 X |
| 3,784,325 | 1/1974 | Coanda et al. | 417/197 X |

*Primary Examiner*—William L. Freeh
*Assistant Examiner*—Edward Look
*Attorney, Agent, or Firm*—Karl F. Ross

[57] ABSTRACT

The invention refers to a device for the continuous gas-lift exploitation of petroleum deposits by means of a depression effect and of a gas-dynamic pulverization. The device according to the invention, consists of a cylindrical adapting piece in which a threaded sleeve is screwed, coupled, in its turn, with a male union provided at its upper end with a profiled wall which, together with the cylindrical adapting piece, shapes a straight depressionary baffle, the profiled part having a curved profiled wall which, together with the profiled wall of the male union, shapes a peripherical annular slot. The nozzle consists of the baffle and slot whose dimensions can be modified as a function of the production depth by dimensionally modifying the profiled part. The slot communicates with an equalization chamber, circumferentially provided with some apertures for the supply of lift gases. Erosion reduction of parts is achieved by means of a protective coating of metallic oxides. The device is mounted on the pipe string.

1 Claim, 2 Drawing Figures

GAS-LIFT DEVICE

FIELD OF THE INVENTION

The invention refers to a device and to a nozzle for the continuous gas-lift exploitation of the petroleum deposits by means of a depression effect and a gas-dynamic pulverization.

BACKGROUND OF THE INVENTION

Devices are known for increasing the output of petroleum wells by the gas-lift principle especially during flow-rate-decrease periods, when the pressure of the subterranean reservoir becomes insufficient to entrain the petroleum to the surface. With this aim in view, lift gases under pressure are continously or intermittently introduced, at certain levels, into the tubing or well string.

Another device, meant to entrain the petroleum from the well, uses ejectors mounted inside the tubing, concomitantly a pulverization of the petroleum and its mixing with the lift gas, the dimensions of the annular slot covering the ejection nozzle varying as a function of the conditions within the well.

These devices have the disadvantage of requiring large working pressures and a considerable consumption of lits gases and, when the petroleum is entrained as oil slugs alternating with gas slugs, there is frequently a downslide motion of the petroleum along the inner walls of the tubing, thus reducing the efficiency and increasing the gas consumption.

There is still another device using, to improve the well efficiency and reduce gas consumption, the Coanda effect. This device operates by means of pumping the lift gas through an annular space, previously sealed with a packer over the orifices. The gas is introduced into the tubing at different levels, through some annular slots having adjustable openings. Above these slots there is a Venturi nozzle allowing the fluid jet deflection along the inner walls of the nozzle due to the Coanda effect and the active upward entrainment of the fluid, concomitantly with the dispersal of the slugs by their pulverization into the mass of the lift gas.

The disadvantage of this device is that it has a low efficiency under the circumstances of an unsteady functioning and of a great consumption of lift gases.

SUMMARY OF THE INVENTION

The device, according to the invention, avoids the above mentioned disadvantages by providing a cylindrical adapting piece in which a threaded sleeve is screwed. The sleeve is coupled with a male union provided at its upper end with a profiled wall which, together with the cylindrical adapting piece, defines a straight depressionary baffle. The profiled part or wall has a curved profile which, together with the profiled wall of the male union, defines a peripherical annular slot. The nozzle of the invention consists of the baffle and slot whose dimensions can be modified as a function of the production depth by dimensionally modifying the profiled part. The slot communicates with an equalization chamber, circumferentially formed with some apertures for the supply of lift gases. Erosion reduction of the parts is achieved by a protective layer of metallic oxides. The device of the invention is mounted on the well string.

SPECIFIC DESCRIPTION

Figure 1:
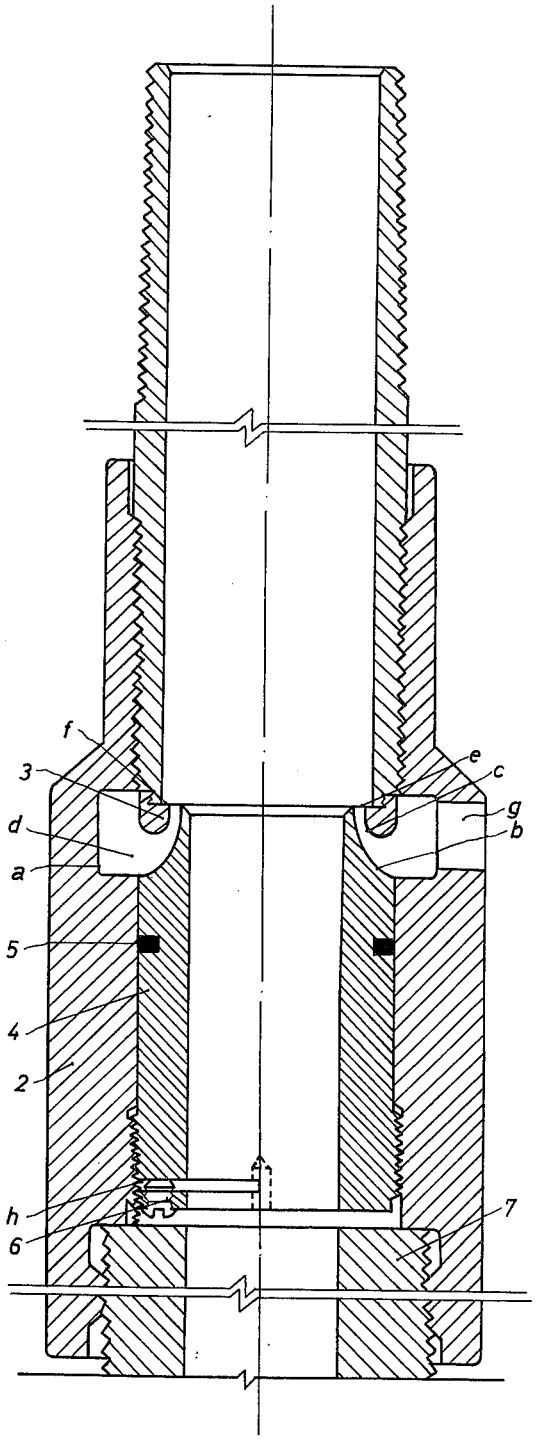
FIG. 1 is a partially sectioned axial view of the device of the invention.

The gas-lift device, according to the invention, consists of a cylindrical adapting piece 1 having its both ends threaded. Onto the lower end of the adapting piece 1 a threaded sleeve 2 is screwed. The sleeve 2 is internally formed with a recess bordered by a wall *a*, the upper end of the recess being located above the lower end of the cylindrical adapting piece 1. The latter is also formed with a male thread; with a male thread onto which a profiled part (ring) 3 is screwed.

A male union or tube 4 is screwed in to the lower female thread of the threaded sleeve 2 and has a profiled wall *b* extending axially in the region of the recess *a* of the threaded sleeve 2. The profiled part 3 has also an outer curved profile *c* so that the wall *a* of the threaded sleeve 2, together with the profiled wall *b* of the male union 4 and with the curved wall *c* of the profiled part 3, defines an equalization chamber *d*, communicating with an axially open peripherical annular slot *e*, the chamber *d* lying outwardly thereof.

The width of the slot *e* can be modified, as a function of the production depth, by correspondingly replacing the profiled part 3.

Figure 2:
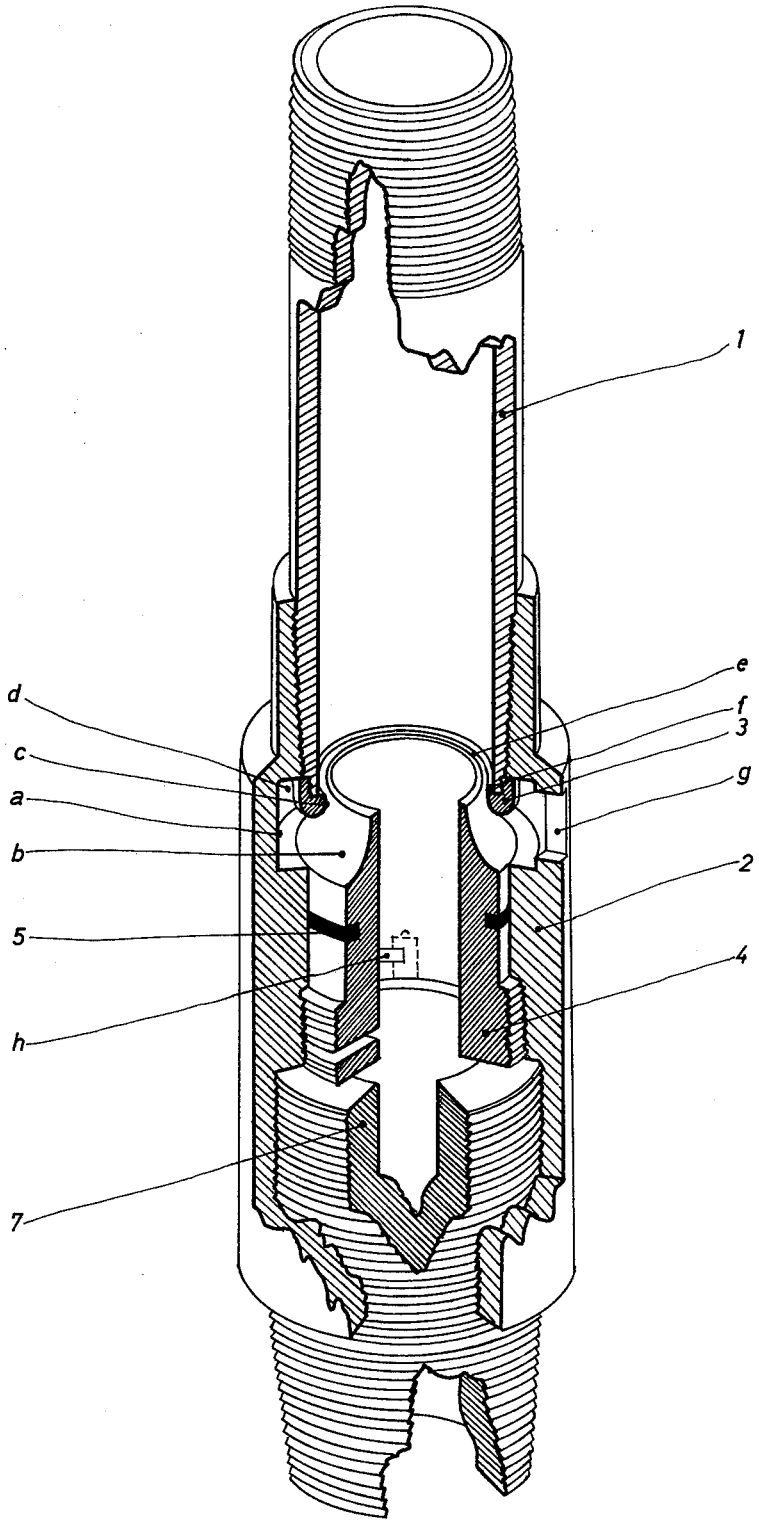
FIG. 2 is a perspective view of the device, partly broken away.

The straight or axially extending cylindrical wall of the profiled part 3, next to the exit section of the slot *e*, shapes, together with the inner wall of the adapting piece 1, a straight depression baffle *f*, thus constituting, together with the slot *e*, the nozzle of the gas-lift device. The baffle *f* as is clear from FIG. 2, is thus formed in a plane perpendicular to the axis of the device by the end face of member 4 and the shoulder at which the cylindrical inner wall of ring 3 lies inwardly of the inner wall of member 1.

The equalization chamber *d* is circumferentially provided, in the wall of the threaded sleeve 2, with some apertures *g* communicating with the lift gas source.

A flexible sealing ring 5 is received in an annular groove effected in the male union 4. A slot *h* is cut in the lower part of the same male union 4, permitting the locking of the union 4 in the threaded sleeve 2 by means of a screw 6 which clamps the opposite sides of the slot together.

A reducing coupling 7, allowing the assemblage of the gas-lift device to the string is screwed in the lower inner part of the threaded sleeve 2.

In order to reduce the erosion of the construction parts, generated by the presence of the sand in the petroleum deposits, a protective covering is applied on the inner walls as a mixture of metallic oxides such as aluminum and titanium oxides, nickel and chrome carbides.

The device, according to the invention, functions as follows:

The lift gases, under pressure, pass from the equalization chamber *d* through the peripherical annular slot *e*, correspondingly dimensioned according to the lift depth, reaching the critical parameters at entering the inner space of the adapting piece 1, where they expand after passage through the peripherical annular slot *e*, creating depression zone within the male union 4.

Due to this zone the upward fluid entrainment is assured. The turbulent flow realizing the homogenization of the liquid-gas mixture, breaking up the liquid slugs.

The lift gases evolution after their leaving the slot depends on the slot width and on the baffle dimensions and is characterized by the existence of the shock waves, typical for under-expanded jets, which assure, in case of an optimal dimensioning of the baffle-slot assembly, the realization of a maximal depression within the threaded sleeve 4 and the avoidance of the petroleum downslide motion along the inner wall of the adapting piece 1.

The device, according to the invention, has the following advantages:

it allows a continous functioning without liquid slugs or pulsations;

it can be used for the gas-lift exploitation of deep wells, as it it able to stand any lift gas pressure; in comparison with the existent devices, it allows the pulverization of a greater quantity of oil;

it allows the reduction of the lift gas consumption and, implicitly, the reduction of the withdrawn gas-oil ratio; and it possesses constructive simplicity and can be safely operated.

We claim:

1. A gas-lift device characterized in that, with the purpose of increasing the efficiency and reducing the lift-gas consumption, it consists of a cylindrical adapting part (1), at the lower end of which is mounted by screwing on a profiled part (3); a joining sleeve (2) in which is screwed internally a male union (4) having an elastic zone (h) cut in its lower portion which permits the blockage of sleeves (2 and 4) by a blocking screw (6); a nozzle for supplying lift-gases, formed of an equalization chamber (d) edged by a profiled inner wall (b) of the male union (4), by a curved profile (c) of the profile part (3) and by the inner wall (a) of the joining sleeve (2), for the communication of the nozzle with the gas supplying duct being provided with some apertures (g) formed circumferentially in the wall of the threaded joining sleeve (2); and annular periphery slot (e), formed between the profiled inner wall (b) of the male union (4) and the curved profile (c) of the profiled part (3); a depressed straight baffle (f) placed at the exit end of the peripheral annular slot (e), the dimensions of which may be modified, as in the case of the slot according to lifting depth, by screwing the profiled part (3) with imposed dimensions.

* * * * *